US008177203B2

(12) United States Patent
Alexander

(10) Patent No.: US 8,177,203 B2
(45) Date of Patent: May 15, 2012

(54) CLAMP AND LEVER THEREFOR

(75) Inventor: John Alexander, Sheffield (GB)

(73) Assignee: Stanley Black & Decker, Inc., New Britain, CT (US)

( * ) Notice: Subject to any disclaimer, the term of this patent is extended or adjusted under 35 U.S.C. 154(b) by 1192 days.

(21) Appl. No.: 11/783,093

(22) Filed: Apr. 5, 2007

(65) Prior Publication Data

US 2008/0246203 A1 Oct. 9, 2008

(51) Int. Cl.
*B25B 5/06* (2006.01)

(52) U.S. Cl. ..... 269/6; 269/3

(58) Field of Classification Search ..... 269/6, 3, 269/199, 166–171.5
See application file for complete search history.

(56) References Cited

U.S. PATENT DOCUMENTS

| | | | |
|---|---|---|---|
| 1,668,511 | A | 5/1928 | McLaughlin |
| 2,731,176 | A | 1/1956 | Crewe |
| 3,233,297 | A | 2/1966 | Havener |
| 4,054,190 | A | 10/1977 | Wilkes |
| 4,339,058 | A | 7/1982 | Wendt |
| 5,005,449 | A | 4/1991 | Sorensen et al. ..... 81/152 |

(Continued)

FOREIGN PATENT DOCUMENTS

DE 202006002404 U1 5/2006

(Continued)

OTHER PUBLICATIONS

British Search Report, dtd Jul. 21, 2008, for corresponding foreign application, 3 pp.

(Continued)

*Primary Examiner* — Lee D Wilson
(74) *Attorney, Agent, or Firm* — Pillsbury Winthrop Shaw Pittman LLP

(57) ABSTRACT

A clamp that includes a bar and a jaw assembly. The jaw assembly is configured to receive the bar to therethrough and to be slidably positionable along the bar. The jaw assembly comprises a lever that forms an aperture through which the bar passes, the lever being movable between an engaged position and a disengaged position within the jaw assembly, wherein if the lever is at the disengaged position within the jaw assembly the lever is slidable along the bar and if the lever is at the engaged position within the jaw assembly the lever engages the bar to hold the lever at a fixed position along the bar, and wherein the lever has a shape that is not substantially straight and reduces the positional difference between the engaged position and the disengaged position.

12 Claims, 5 Drawing Sheets

U.S. PATENT DOCUMENTS

| | | | | |
|---|---|---|---|---|
| 5,192,008 | A | 3/1993 | Hwan | |
| 5,265,854 | A | 11/1993 | Whiteford | 269/3 |
| 5,443,246 | A | 8/1995 | Peterson | 269/283 |
| 5,454,551 | A * | 10/1995 | Hobday | 269/6 |
| 5,494,553 | A * | 2/1996 | Colucci | 156/580 |
| 5,666,964 | A | 9/1997 | Meilus | 128/744 |
| 5,853,168 | A | 12/1998 | Drake | 269/6 |
| 6,113,085 | A | 9/2000 | Lindenthal et al. | |
| 6,170,714 | B1 | 1/2001 | Lesage | |
| 6,382,608 | B1 * | 5/2002 | Michell | 269/6 |
| 6,386,530 | B1 | 5/2002 | Marks | 269/6 |
| 6,450,489 | B1 | 9/2002 | Wang | |
| 6,474,632 | B1 | 11/2002 | Liou | 269/6 |
| 6,619,602 | B2 | 9/2003 | Stevenson | |
| 6,655,670 | B1 | 12/2003 | Liou | |
| 7,017,894 | B1 * | 3/2006 | Lin | 269/6 |
| 7,090,209 | B1 | 8/2006 | Rowlay | 269/6 |
| 2002/0125624 | A1 | 9/2002 | Wang | |
| 2003/0090048 | A1 | 5/2003 | Varzino et al. | 269/95 |
| 2003/0141644 | A1 | 7/2003 | Thomas | |
| 2004/0140602 | A1 | 7/2004 | Gerritsen et al. | 269/6 |
| 2005/0082728 | A1 * | 4/2005 | Cicenas et al. | 269/6 |
| 2005/0184439 | A1 * | 8/2005 | Janson et al. | 269/6 |
| 2006/0226588 | A1 * | 10/2006 | Khachatoorian et al. | 269/6 |
| 2008/0246203 | A1 * | 10/2008 | Alexander | 269/6 |

FOREIGN PATENT DOCUMENTS

| | | |
|---|---|---|
| EP | 1 750 905 | 12/2004 |
| JP | 6143152 | 11/1992 |
| NL | 1016587 C1 | 11/2000 |
| WO | 2005115690 A1 | 12/2005 |

OTHER PUBLICATIONS

Corrected and Further UK Search Reports, dtd Nov. 21, 2008, for corresponding GB0806037.8 application, 2 pp.

Examination Report as issued for Great Britian Application No. 0806037.8, dated Aug. 4, 2011.

* cited by examiner

CLAMP AND LEVER THEREFOR

FIELD OF THE INVENTION

The present invention relates to clamps, and more particularly, levers disposed within clamps to either drive a bar through a jaw assembly or to provide a brake that holds a jaw assembly in a secure position along a bar.

BACKGROUND OF THE INVENTION

Typically levers disposed within clamps to either drive a bar through a jaw assembly or to provide a brake that holds a jaw assembly in a secure position along a bar are straight, plate-like members with apertures formed therein. The aperture of a conventional lever may be designed such that if the lever is positioned at an unengaged position generally perpendicular to a bar, the bar may slide relatively freely therethrough. If the lever is moved from the unengaged position to an engaged position at which the orientation of the lever is at an angle with respect to perpendicular to the bar, the edge surfaces on opposite sides of the aperture engage the bar to secure the position of the lever on the bar.

While various drawbacks may be associated with levers that are configured such that the positional difference between the engaged position and the unengaged position is relatively large, decreasing this positional difference with a conventional, substantially straight lever may require one or both of increasing the thickness of the lever or decreasing a clearance between the bar and the aperture formed in the lever. However, each of these solutions has various drawbacks.

SUMMARY

One aspect of the invention relates to a clamp. In one embodiment, the clamp comprises a bar, and a jaw assembly. The jaw assembly is configured to receive the bar to therethrough and to be slidably positionable along the bar. The jaw assembly comprises a lever that forms an aperture through which the bar passes, the lever being movable between an engaged position and a disengaged position within the jaw assembly, wherein if the lever is at the disengaged position within the jaw assembly the lever is slidable along the bar and if the lever is at the engaged position within the jaw assembly the lever engages the bar to hold the lever at a fixed position along the bar, and wherein the lever has a shape that is not substantially straight and reduces the positional difference between the engaged position and the disengaged position.

Another aspect of the invention relates to a jaw assembly for a bar clamp. In one embodiment, the jaw assembly comprises a housing and a lever. The housing is configured to enable a bar to pass therethrough. The lever is disposed within the housing, and forms an aperture adapted to receive the bar therethrough. The lever is movable between an engaged position and a disengaged position within the housing, wherein if the lever is at the disengaged position within the housing the lever is slidable along the bar and if the lever is at the engaged position within the housing the lever engages the bar to hold the lever at a fixed position along the bar, and wherein the lever has a shape that is not substantially straight and reduces the positional difference between the engaged position and the disengaged position.

Another aspect of the invention relates to a lever for use in a jaw assembly of a bar clamp. In one embodiment, the lever comprises one or more distal edge surfaces and one or more innter edge surfaces. The one or more distal edge surfaces forms an outer edge of the lever. The one or more inner edge surfaces form an aperture configured to receive a bar therethrough such that (i) if the lever is at a disengaged position within the jaw assembly the bar will slide through the aperture and (ii) if the lever is at an engaged position within the jaw assembly the lever will engage the bar to hold the lever at a fixed position along the bar, wherein the lever has a shape that is not substantially straight and reduces the positional difference between the engaged position and the disengaged position.

Another aspect of the invention relates to a lever for use in a jaw assembly of a bar clamp, the lever forming an aperture to receive a bar therethrough. In one embodiment, the lever comprises a first surface, a second surface, a first engagement portion, and a second engagement portion. The first surface is opposite the second surface. The first engagement portion engages one side of the bar when the lever is in an engaged position, the first engagement portion being formed at or near the first surface of the lever. The second engagement portion engages an opposite side of the bar when the lever is in the engaged position, the second engagement portion being formed at or near the second surface of the lever. The lever is formed to have a certain thickness between the first surface and the second surface in a region proximate the first engagement portion, and further being formed such that if the first surface of the lever of the lever is oriented generally perpendicularly to a longitudinal axis of the bar the distance along the axis between the first and second engagement portions is greater than the certain thickness.

Another aspect of the invention relates to a lever for use in a jaw assembly of a bar clamp, the lever forming an aperture to receive a bar therethrough. In one embodiment, the lever comprises a first engagement portion and a second engagement portion. The first engagement portion engages one side of the bar when the lever is in an engaged position, the first engagement portion being formed at or near the first surface of the lever. The second engagement portion engages an opposite side of the bar when the lever is in the engaged position, the second engagement portion being formed at or near the second surface of the lever. The lever is formed from a material that has a thickness of between about 5 mm and about 15 mm, and is formed such that if the lever is rotated from the engaged position by a lock angle to an unengaged position in which the lever is substantially perpendicular to a longitudinal axis of the bar, a clearance is provided between the first and second engagement portions and the bar that enables the bar to slide freely through the aperture, the lever further being formed such that the lock angle is between about 1 degree and about 2 degrees.

DETAILED DESCRIPTION

Figure 1:
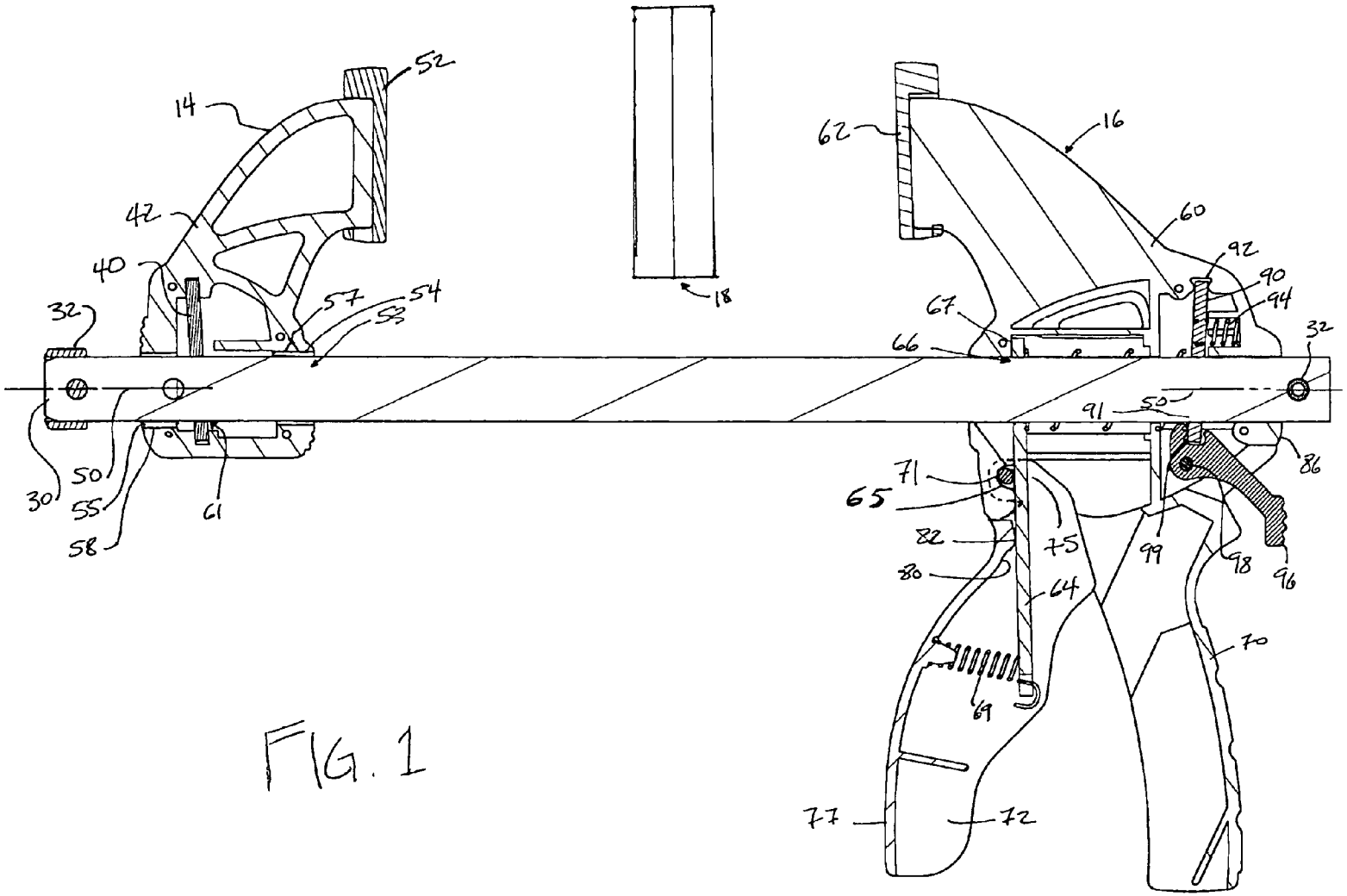
FIG. 1 illustrates an adjustable clamp, in accordance with one or more embodiments of the invention.

FIG. 1 illustrates an adjustable clamp 10 having a bar 12, a moving jaw 14, and a fixed jaw 16. In one embodiment, clamp 10 may include one or more of the structures and features of the clamp shown and described in U.S. Pat. No. 7,090,209 to Rowlay, the entire contents of which are incorporated herein by reference. Clamp 10 may be used by positioning jaws 14 and 16 on opposite sides of a workpiece or member 18 to be clamped. The fixed jaw 16 is then activated to pull the bar 12 through the fixed jaw 16, thus bringing moving jaw 14 closer to fixed jaw 16. Jaws 14 and 16 include one or more levers (e.g., braking lever 40, drive lever 64, and braking lever 90) configured to selectively engage and disengage bar 12 to enable jaws 14 and/or 16 to be secured in position along bar 12.

Bar 12 is preferably a solid bar formed of sufficiently rigid material, such as metal or plastic. The bar 12 may have an inserting end 30 and a stop 32 to permit the jaws 14 and 16 to be inserted on the bar and removed from the same end, that is, via the inserting end 30. Alternatively, as discussed with other embodiments, the bar 12 may be formed without a stop 32 and the jaws 14 and 16 may be placed on and taken off the bar 12 at either end.

Although the moving jaw 14 may be any of the various moving-type jaws known in the prior art, moving jaw 14 is illustrated as having a braking lever 40 positioned within the moving jaw housing 42. The moving jaw housing 42 includes an opening 53 for permitting the bar 12 to pass therethrough. Also, the braking lever 40 includes an aperture 61 for permitting the bar 12 to pass therethough. As seen in FIG. 1, the opening 53 permits a first clearance gap 54 between the bar 12 and a first surface 57 of the housing 42, and a second clearance gap 55 between the bar 12 and a second surface 58 of the housing 42. The principle of adjustment of moving jaw 14 is based on the ability of moving jaw 14 to rotate relative to bar 12 in order to move the braking lever 40 between an unengaged position wherein the braking lever 40 is substantially perpendicular to axis 50 of bar 12 to allow movement of moving jaw 14 in both directions along the bar 12, as desired, and an engaged position (shown in FIG. 1) wherein the breaking lever 40 is no longer normal to the axis 50 of the bar 12 and engages the bar 12. The opening 53 through jaw housing 42 receiving bar 12 has sufficient clearance with respect to the bar 12, including with first and second clearance gaps 54 and 55, to enable sufficient rotation of moving jaw 14 relative to the bar 12 to both enable engagement and disengagement of braking lever 40 with bar 12. Thus, the moving jaw 14 may be moved to a selected position on the bar 12 in either direction along the bar 12 and then be clamped against member 18 upon activation of the fixed jaw 16. When the moving jaw 14 is clamped against a member 18, the clamping force rotates the moving jaw 14 (in a counter-clockwise direction with respect to FIG. 1) to the engaged position illustrated in FIG. 1 so that the braking lever 40 engages the bar 12. The moving jaw 14 has a clamping face 52 for engaging member 18. When the moving jaw 14 is clamped against the member 18, the moving jaw 14 is in the locked position with respect to the bar 12. When the clamping force is released, the moving jaw 14 may be pivoted back to the unengaged position (in a clockwise direction with respect to FIG. 1). Member 18 is any member or members to be clamped. For example, member 18 may be two elements that are being joined together by adhesive and require a clamping force to ensure a tight connection while the adhesive cures.

Fixed jaw 16, as illustrated in FIG. 1, has a main section that is structured and arranged to permit the bar 12 to passthrough. As illustrated, the main section is a housing 60 having an aperture 63 extending completely therethrough for the passage of bar 12. The fixed jaw 16 also has a clamping face 62 extending from said housing 60. A drive lever 64 is disposed within the housing 60 and is structured and arranged to directly couple the bar 12 when located at an engaged position within housing 60. The illustrated drive lever 64 has an aperture 66 formed therein for the passage of bar 12. The size of the aperture 66 in drive lever 64 is slightly larger than the cross section of the bar 12, so when the angle of bar 12 is inclined with respect to a line perpendicular to the longitudinal axis 50 of the bar 12 (i.e., the drive lever 64 is in the engaged position), a tight, slip-free fit is created between the bar 12 and the drive lever 64. In contrast, when the drive lever 64 becomes substantially perpendicular to longitudinal axis 50, the engagement between drive lever 64 is released and bar 12 slides freely through aperture 66. The drive lever 64 is pivotably movable within the housing 60 from the engaged position to a disengaged position. Drive lever 64 may be maintained within its area of movement within the housing 60 by housing 60 itself. For example, the disposal of bar 12 through aperture 66 may hold drive lever 64 in position with respect to bar 12, while the walls of housing 60 (e.g., surface 67) may contain drive lever 64, thereby preventing drive lever 64 from pivoting around bar 12. Drive lever 64 is biased by one or more resilient elements, such as a first spring 68 and a second spring 69, in a direction away from handle 70. Handle 70 extends from housing 60 for grasping by a user.

A trigger 72 is pivoted to the main section housing 60. The trigger 72 may pivot, for example, about a lug 71 extending from an upper portion 75 of the trigger 72. The lug 71 may pivot within a recess 65 formed in the inner surface of housing 60 that has a complementary shape to the shape of the lug 71. In the embodiment illustrated in FIG. 1, trigger 72 is pivotable with respect to the housing 60 about lug 71 toward handle 70. A lower portion 77 of the trigger 72 remains unattached to housing 60 and/or handle 70, and moves in coordination with the pivoting of the trigger 72. The trigger 72 is formed as a hollow channel defined by three sides, and has an opening facing the handle 70. The inner contact surface 80 is the interior side of the trigger 72 that is most remote from the body of handle 70, and is adjacent to the drive lever 64. The inner contact surface 80 provides the points of contact of the trigger 72 with the drive lever 64.

The trigger 72 is shown in the nonactuated position in FIG. 1. When the trigger 72 is in the nonactuated position, the drive lever 64 is biased against the inner surfaces of housing 60 and trigger 72 (e.g., surface 67 of housing 60 and of inner contact surface 80 of trigger 72) by the force of the drive lever 64 via the biasing of springs 68 and 69. In this nonactuated position, the trigger 72 has an initial contact point 82 on the contact surface 80 that is in contact with the drive lever 64. The initial contact point 82 may be in the form of a projection 82 formed on surface 80, as illustrated.

When the trigger 72 initially is pulled by a hand of the user it pivots about lug 71 toward the handle 70 out of the nonactuated position, the interaction between trigger 72 (e.g., at contact point 82) and the drive lever 64 overcomes the bias provided by spring 69 such that the bias provided by spring 69 and the interaction between trigger 72 and drive lever 64 pivots driver lever 64 into an engaged position in which the portions of drive lever 64 at the periphery of aperture 66 engage bar 12. Once drive lever 64 is pivoted into the engaged position, the drive lever 64 pulls the bar 12 toward the rear end 86 of housing 60.

When trigger 72 is released, contact between trigger 72 and drive lever 64 no longer applies a force to drive lever 64 that opposes the bias applied by spring 69, which then cooperates with the bias provided by spring 68 to pivot drive lever 64 with respect to the perpendicular of longitudinal axis 50, thereby holding drive lever 64 in the engaged position. Thus, the biases applied by springs 68 and 69 pivot drive lever 64 back into the unengaged position and cause drive lever 64 to slide along bar 12 away from the rear end 86 of housing 60 back to the position shown in FIG. 1. In this manner, the user may cause fixed jaw 16 to move incrementally down bar 12.

As fixed jaw 16 is drawn incrementally down bar 12 toward (or away from moving jaw 14 if fixed jaw 16 is oriented in the opposite direction from the direction shown in FIG. 1) moving jaw 14, a braking lever 90 secures housing 60 in position on bar 12 at each incremental location. The principles of locking are similar to those of the braking lever 40 of the moving jaw 14 and of the drive lever 64 of the fixed jaw 16. The braking lever 90 is pivotable in the housing 60 within a groove 92 and is biased by a resilient element, such as a spring 94 into an engaged position in which the lever 90 is pivoted to a non-perpendicular orientation with respect to axis 50, so that edge surfaces on opposite sides of an aperture 91 formed in braking lever 90 engages bar 12. The bias applied by spring 94 is such that when the trigger 72 is pulled, and the bar 12 is drawn toward the rear 86 of housing 60 by drive lever 64, the pressure between the edge surfaces of aperture 91 and bar 12 is relieved somewhat. This may not entail bringing braking lever 90 completely into an unengaged position in which braking lever 90 is positioned substantially perpendicular to longitudinal axis 50, thereby removing the edge surfaces of aperture 91 from engagement with bar 12 (similar to the unengaged position of drive lever 64 discussed above) and permitting uninhibited movement of bar 12 toward the rear 86 of housing 60. However, the release of pressure between the edge surfaces of aperture 91 and bar 12 will enable bar 12 to be pulled through aperture toward the rear 86 of housing 60. The bias of spring 94 also ensures that any movement of bar 12 in the opposite direction (opposite the driving of bar 12 toward the rear 86 of housing 60) will pivot braking lever 90 with respect to the perpendicular to longitudinal axis 50, bringing braking lever 90 back into the engaged position and thereby securing the location of housing 60 on bar 12.

When it is desired to move the bar 12 through the fixed jaw 16 toward the clamping face 62, a release button 96 is used to move the bottom of braking lever 90 toward the rear 86 of housing 60. This places braking lever 90 in the unengaged position, and releases the bar 12 to move in the forward direction. The release button 96 is pivoted to the housing at pivot 98 and has a mid-portion 99 that captures the bottom of braking lever 90 as release button 96 is pivoted in the clockwise direction in FIG. 1. As mid-portion 99 captures the bottom of braking lever 90, and as release button 96 is pivoted further, the bottom of braking lever 90 is actuated by mid-portion 99 toward the rear end 86 of housing 60. Moving the bottom of braking lever 90 toward the rear end 86 of housing 60 moves braking lever 90 perpendicular to longitudinal axis 50, thereby removing the engagement between the edges of aperture 91 and bar 12 and enabling braking lever 90 (and housing 60) to be moved along bar 12.

As is shown in FIG. 1, typically levers such as braking lever 40, drive lever 64, and braking lever 90 are substantially straight members formed from a lamina sheet material. As used herein, the term "straight" refers to plate-like members with two opposing surfaces that are substantially flat and parallel to each other, at least in the vicinity of the lever that receives the bar. However, in order to enhance various aspects of the operation of clamp 10, alternative, levers can be implemented. The shape of a given lever may be designed to decrease the positional difference between the engaged and unengaged positions of the given lever. This may include a reduction in the angle of pivot between the engaged and unengaged positions (e.g., a "lock angle"). For example, for levers formed as substantially straight members that are manufactured from a material with a plate thickness between about 2 mm and about 6 mm (e.g., about 4 mm), the lock angle is typically approximately 3.4 degrees. In some embodiments, the lock angles of such levers are between about 3.1 degrees and about 3.7 degrees.

Figure 2A:
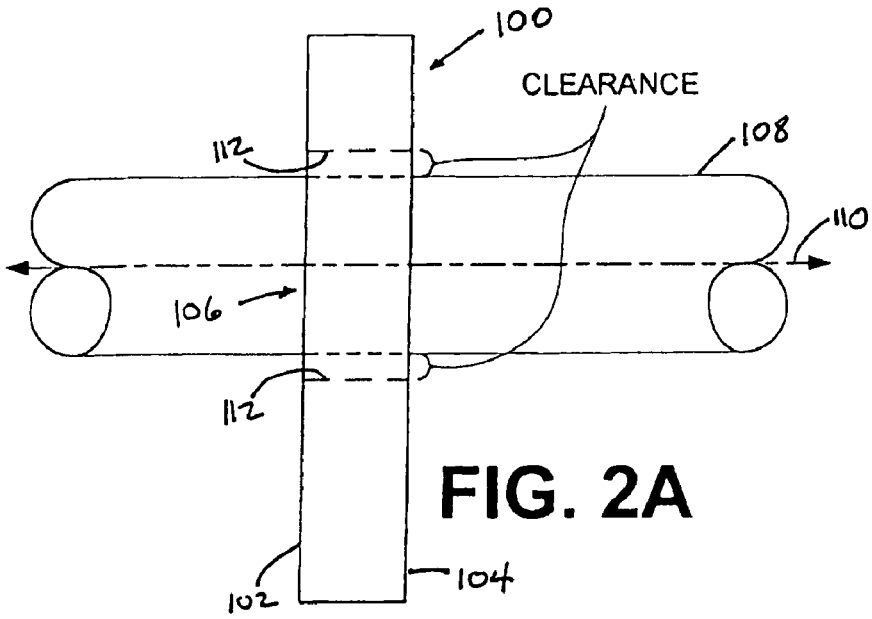
FIGS. 2A and 2B illustrate the operation of a substantially straight lever within a clamp, according to one or more embodiments of the invention.
Figure 2B:
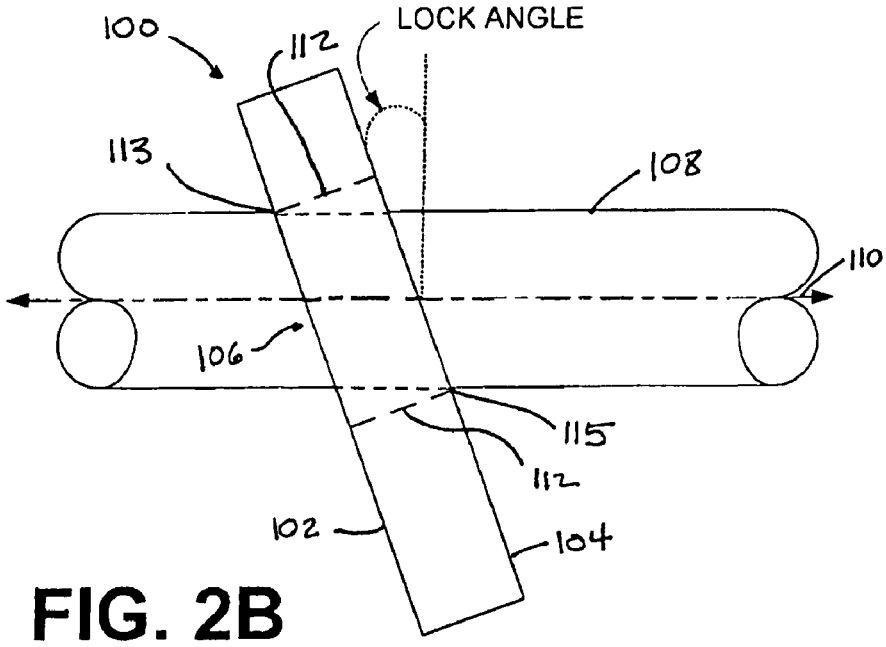

FIGS. 2A and 2B illustrate a substantially straight lever 100 suitable for implementation in a jaw assembly of a clamp, such as either of jaws 14 or 16 of clamp 10. Lever 100 includes opposing surfaces 102 and 104 that are substantially flat and parallel to each other. Lever 100 forms an aperture 106 at least slightly larger than a cross-section of a bar 108 (e.g., similar to bar 12 of FIG. 1) such that bar 108 may pass through aperture 106. In an unengaged position (illustrated in FIG. 2A), opposing surfaces 102 and 104 are oriented substantially perpendicular to a longitudinal axis 110 of bar 108, which enables bar 108 to slide through aperture 106. From the unengaged position, lever 100 may move to an engaged position (illustrated in FIG. 2B). In the engaged position, lever 100 is pivoted such that opposing surfaces 102 and 104 reach a lock angle with respect a perpendicular of longitudinal axis 110 of bar 108. As opposing surfaces 102 and 104 reach the lock angle, inner edge surfaces 112 on opposite sides of the aperture 106 in lever 100 engage bar 108 to secure the position of lever 100 on bar 108. More particularly, a first corner 113 on one of the edge surfaces 112 on the first side surface 102 acts as a first engagement portion that engages a first side of bar 108, and a second corner 115 on an opposite one of edge surfaces 112 on the second side surface 104 acts as a second engagement portion that engages a second, opposite side of bar 108.

In instances in which lever 100 is a substantially straight member, the lock angle is a function of at least 2 variables: (1) the thickness of lever 100 (i.e., the distance between surfaces 102 and 104), and (2) the clearance between inner edges 112 of lever 100 and bar 108 when lever 100 is in the disengaged position (e.g., the difference between the size of aperture 106 and the cross-section of bar 108). The thickness of lever 100 is inversely proportional to the lock angle, while clearance between inner edge 112 and bar 108 is directly proportional to the lock angle.

The size of the lock angle corresponds to a positional difference between the engaged and unengaged positions of lever 100. The larger the lock angle, the greater the positional difference between the engaged and unengaged positions of lever 100. In a clamp, such as clamp 10 shown in FIG. 1 and discussed above, the size of the lock angle and/or the positional difference between the engaged and unengaged positions of lever 100 impacts the functionality of the clamp. For instance, a reduced positional difference between the engaged and unengaged positions of lever 100 may be considered beneficial for a variety of reasons. One such reason is that the positional difference between the engaged and unengaged positions of a drive lever (e.g., drive lever 64) may translate into ineffective, or non-driving, movement of a trigger (e.g., trigger 72) used to pull bar 108 through the jaw assembly including lever 100 by actuating lever 100 with respect to the rest of the jaw assembly. The non-driving movement is the movement of the trigger that corresponds to the movement of the drive lever between the engaged and unengaged positions. This non-driving movement of the trigger results in a reduction of the incremental distance by which bar 108 is drawn through the jaw assembly by actuation of the trigger. In some instances, the non-driving movement of the trigger may be perceived by the user as being the result of a low quality product.

In order to reduce the positional difference between the engaged and disengaged positions of lever 100, the clearance between inner edge 112 and bar 108 may be reduced and/or the thickness of lever 100 may be increased. However, each of these measures may be associated with drawbacks. For example, the clearance may only be reduced to a certain point without impairing the ability of lever 100 to slide freely along bar 108 while lever 100 is in the unengaged position. Similarly, increasing the thickness of lever 100 may increase the cost and/or difficulty of manufacturing lever 100, and/or may require more room within the body of the jaw assembly to accommodate the greater thickness. In some embodiments, the thickness of lever 100 is between about 2 mm and about 6 mm (e.g., about 4 mm) and the lock angle of lever 100 is between about 3.1 and about 3.7 degrees (e.g., about 3.4 degrees).

Figure 3A:
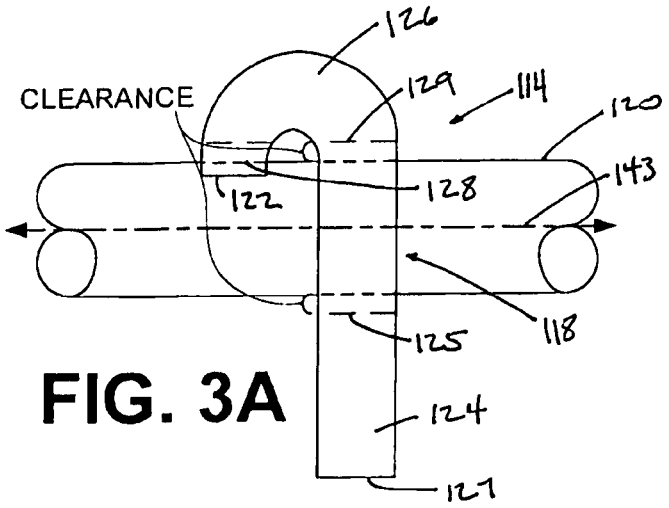
FIGS. 3A-3C illustrate the operation of a lever within a clamp, in accordance with one or more embodiments of the invention.
Figure 3B:
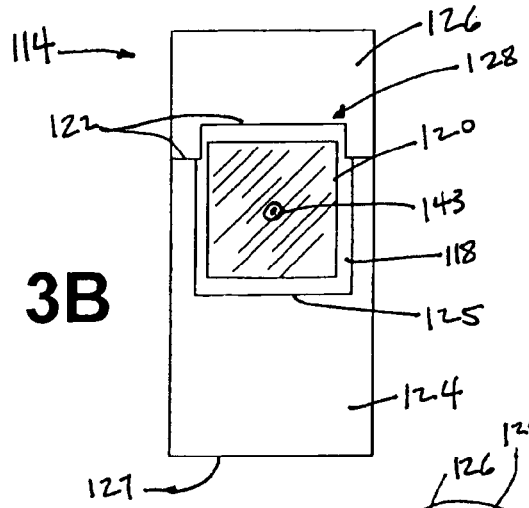
Figure 3C:
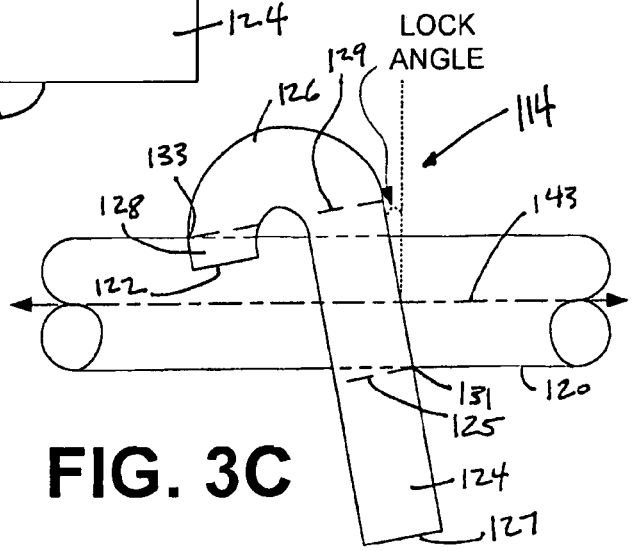

FIGS. 3A-3C illustrate a lever 114 designed to reduce the positional difference between the engaged and unengaged positions of lever 114, in accordance with one embodiment of the invention. As can be seen in FIG. 3A, lever 114 includes inner edge surfaces that form an aperture 118 adapted to receive a bar 120 therethrough, and distal edges that form an outer boundary of lever 114. A first tab 124 is formed by lever 112 between a first inner edge surface 125 and a first distal edge surface 127 on one side of bar 120, and a second tab 126 is formed by lever 112 between a second inner edge surface 129 and a second distal edge surface 122 on a side of bar 120 opposed to first tab 124. From the elevation view of lever 114 shown in FIG. 3A, it can be seen that second tab 126 is arcuate in shape, giving the elevation view of lever 114 an overall hook-like shape. The second distal edge surface 122 of lever 114 at second tab 126 may include a slot 128 configured to receive bar 120 in an engaged position of lever 114 (shown in FIG. 3C and described below).

Referring to FIG. 3B, an elevation of lever 114 is shown along bar 120 (from the left in FIGS. 3A and 3C). The elevation of lever 114 shown in FIG. 3B illustrates the relationship between aperture 118 and bar 120. Further, FIG. 3B shows how slot 128 formed in second distal edge surface 122 complements bar 120 such that bar 120 passes through slot 128.

If lever 114 is in the unengaged position illustrated in FIGS. 3A and 3B, bar 120 is able to slide relatively freely through aperture 118. However, lever 114 may be pivoted with respect to bar 120 into the engaged position, illustrated in FIG. 3C, in which lever 114 engages bar 120 to secure lever 114 at a fixed location along bar 120. More particularly, bar 120 is engaged at the engaged position by a first engagement portion of lever 114 formed by a corner 131 of first inner edge surface 125 and by a second engagement portion of lever 114 formed by a corner 133 of second distal edge surface 122. The corner 133 of second distal edge surface 122 that engages bar 120 is formed within slot 128 of distal edge surface 122. The engagement between bar 120 and corner 133 of second distal edge surface 122 of lever 114 occurs due to the arcuate shape of second tab 126, although it should be appreciated that the arcuate shape of second tab 126 may be replaced by any shape that folds second tab 126 back onto itself to enable some portion of distal edge surface 122 to engage bar 120 when lever 114 is at the engaged position.

It can be seen in FIGS. 3A-3C that due to the arcuate shape (or other similar shape) of lever 114, if the first tab 124 of lever 114 is oriented generally perpendicularly to a longitudinal axis 143 of bar 120, the axial distance along axis 143 between the first and second engagement portions of lever 114 (i.e., corners 131 and 133) is greater than a thickness of lever 114 at or near the first engagement portion (i.e. corner 131). This enables the engagement between bar 120 and second distal edge surface 122 to occur at a smaller lock angle than an engagement that would occur between bar 120 and some portion of second inner edge surface 129 of lever 114 if second tab 126 were shaped similarly to first tab 124 (e.g., straight). Further, this reduction in the lock angle, or the reduction in the positional difference between the engaged and unengaged positions of lever 114, is accomplished without (1) reducing the clearance between bar 120 and aperture 118 or (2) increasing the thickness of lever 114. Thus, the implementation of lever 114 illustrated in FIGS. 3A-3C may provide the enhancements of a relatively small positional difference between the engaged and unengaged positions without introducing any of the drawbacks associated with a reduced clearance and/or an increased plate thickness. In some embodiments, the thickness of lever 114 is between about 2 mm and about 6 mm (e.g., about 4 mm) and the lock angle of lever 114 is between about 1 degree and about 2 degrees (e.g., about 1.3 degrees-about 1.5 degrees).

Figure 4A:
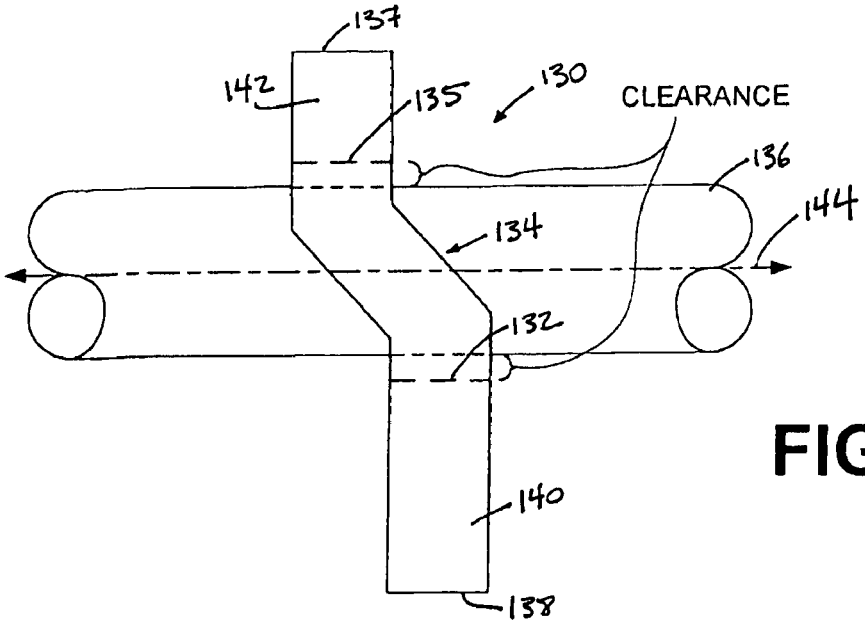
FIGS. 4A and 4B illustrate the operation of a lever within a clamp, in accordance with one or more embodiments of the invention.
Figure 4B:
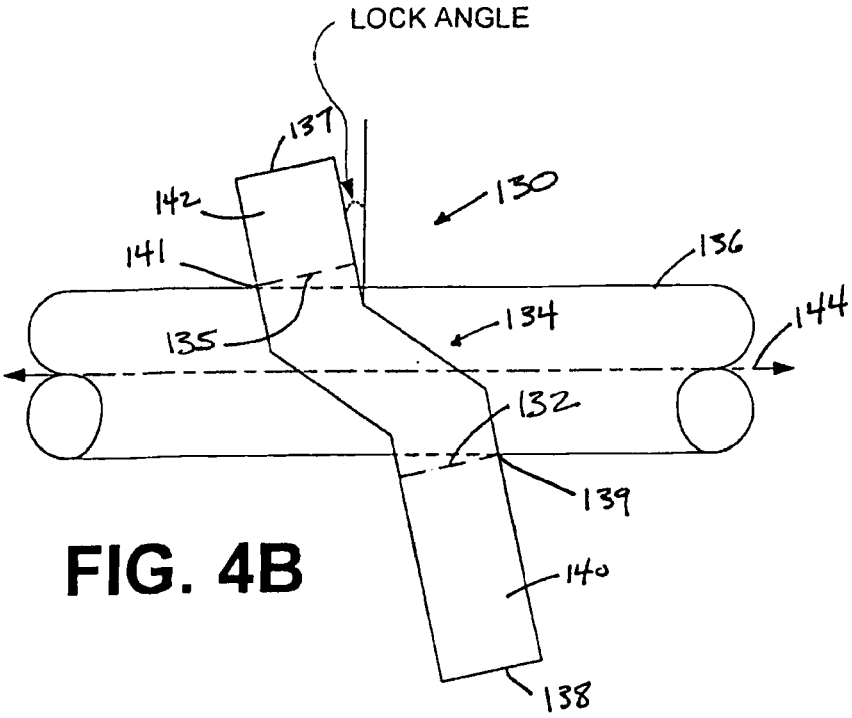

FIGS. 4A and 4B illustrate another lever 130 designed to reduce the positional difference between the engaged and unengaged positions of lever 130, in accordance with one embodiment of the invention. As can be seen in FIG. 4A, lever 130 includes inner edge surfaces that form an aperture 134 adapted to receive a bar 136 therethrough, and distal edges that form an outer boundary of lever 130. A substantially straight first tab 140 is formed by lever 130 between a first inner edge surface 132 and a first distal edge surface 138 on one side of bar 136, and a substantially straight second tab 142 is formed by lever 130 between a second inner edge surface 135 and a second distal edge surface 137 on a side of bar 136 opposed to first tab 140. From the elevation view of lever 130 shown in FIG. 4A, it can be seen that the plane of second tab 142 is parallel (or substantially so) to the plane of first tab 140, and that the planes of tabs 140 and 142 are perpendicular (or substantially so) to a longitudinal axis 144 of bar 136. Further, it can be seen that the planes of tabs 140 and 142 are offset with respect to each other in a direction that is parallel to axis 144 (e.g., a direction perpendicular to the planes themselves).

If lever 130 is in the unengaged position illustrated in FIG. 4A, bar 136 is able to slide relatively freely through aperture 134. However, lever 130 may be pivoted with respect to bar 136 into an engaged position, illustrated in FIG. 4B, in which lever 130 engages bar 136 to secure lever 130 at a fixed location along bar 136. More particularly, bar 136 is engaged at the engaged position by a first engagement portion formed by a corner 139 of inner edge surface 132 and, by a second engagement portion formed by a corner 141 of inner edge surface 135.

It can be seen in FIG. 4B that due to the longitudinal offset of tabs 140 and 142 of lever 130, if the planes of tabs 140 and 142 are oriented generally perpendicular (or substantially so) to a longitudinal axis 144 of bar 136, the distance along axis 144 between the first and second engagement portions of lever 130 (i.e., corners 139 and 141) is greater than a thickness of lever 130 at or near the first engagement portion (i.e. corner 139). This enables the engagement between bar 136 and lever 130 to occur at a smaller lock angle than if lever 130 were wholly substantially straight. Further, this reduction in the lock angle, or the reduction in the positional difference between the engaged and unengaged positions of lever 130, is accomplished without (1) reducing the clearance between bar 136 and aperture 134 or (2) increasing the thickness of lever 130. Thus, the implementation of lever 130 illustrated in FIGS. 4A and 4B may provide the enhancements of a relatively small positional difference between the engaged and unengaged positions without introducing any of the drawbacks associated with a reduced clearance and/or an increased plate thickness. In some embodiments, the thickness of lever 130 is between about 2 mm and about 6 mm (e.g., about 4 mm) and the lock angle of lever 130 is between about 1 degree and about 2 degrees (e.g., about 1.3 degrees-about 1.5 degrees).

Figure 5A:
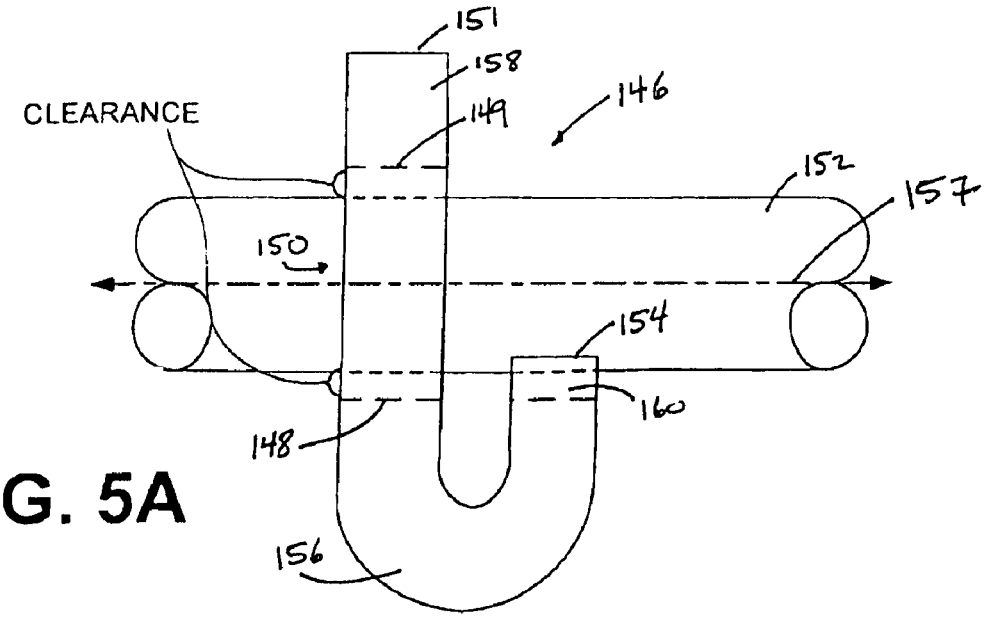
FIGS. 5A and 5B illustrate the operation of a lever within a clamp, according to one or more embodiments of the invention.
Figure 5B:
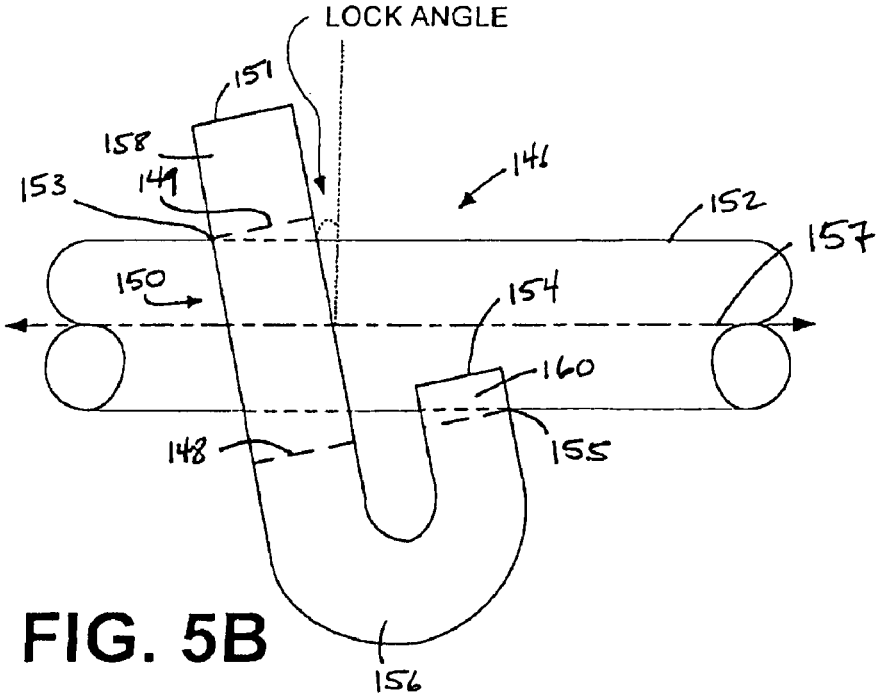

FIGS. 5A and 5B illustrate another lever 146 designed to reduce the positional difference between the engaged and unengaged positions of lever 146, in accordance with one embodiment of the invention. Lever 146 is an inverted version of lever 114 illustrated in FIGS. 3A-3C. This inverted version may be implemented in place of lever 114 for various design reasons. For example, with lever 114 the bulkier portion is on one side of the lever, while with lever 146 the bulkier portion is on the other side of the lever. As another example, lever 114 may engage the bar with an enhanced efficiency (e.g., a smaller locking angle, a more secure engagement, etc.) with respect to lever 146 in instances in which the engaged position of the lever is rotationally displaced from the unengaged position in the rotational direction illustrated in FIGS. 3A-3C and FIGS. 5A and 5B (e.g., counter-clockwise).

As can be seen in FIG. 5A, lever 146 includes inner edge surfaces that forms an aperture 150 adapted to receive a bar 152 therethrough, and distal edge surfaces that form an outer boundary of lever 146. A first tab 156 is formed by lever 146 between a first inner edge surface 148 and a first distal edge surface 154 on one side of bar 152, and a second tab 158 is formed by lever 146 between a second inner edge surface 149 and second distal edge surface 151 on a side of bar 152 opposed to first tab 156. From the elevation view of lever 146 shown in FIG. 5A, it can be seen that first tab 156 is arcuate in shape, giving the elevation view of lever 146 an overall hook-like shape. The first distal edge surface 154 of lever 146 at first tab 156 may include a slot 160 configured to receive bar 152 in an engaged position of lever 146 (shown in FIG. 5B and described below).

If lever 146 is in the unengaged position illustrated in FIG. 5A, bar 152 is able to slide relatively freely through aperture 150. However, lever 146 may be pivoted with respect to bar 152 into the engaged position, illustrated in FIG. 5B, in which lever 146 engages bar 152 to secure lever 146 at a fixed location along bar 152. More particularly, bar 152 is engaged at the engaged position by a first engagement portion formed by corner 153 of first inner edge surface 149 at second tab 158, and by a second engagement portion formed by a corner 155 of second distal edge surface 154 at first tab 156. Second distal edge surface 154 may engage bar 152 at slot 160 formed therein (similar to the engagement of bar 120 at slot 122 in FIG. 3B). The engagement between bar 152 and distal edge 154 of lever 146 at first tab 156 occurs due to the arcuate shape of first tab 156, although it should be appreciated that the arcuate shape of first tab 156 may be replaced by any shape that folds first tab 156 back towards itself to enable distal edge 154 to engage bar 152 at the engaged position.

It can be seen in FIG. 5B that due to the arcuate shape (or other similar shape) of lever 146, if the planes of second tab 158 is oriented generally perpendicular (or substantially so) to a longitudinal axis 157 of bar 152, the distance along axis 157 between the first and second engagement portions of lever 146 (i.e., corners 153 and 155) is greater than a thickness of lever 146 at or near the first engagement portion (i.e. corner 153). This enables the engagement between bar 152 and first distal edge surface 154 to occur at a smaller lock angle than an engagement that would occur between bar 152 and inner edge 148 of lever 146 at first tab 156 if first tab 156 were shaped similarly to second tab 158 (e.g., straight). Further, as with the implementations illustrated in FIGS. 3A-B and 4A-B, this reduction in the lock angle, or the reduction in the positional difference between the engaged and unengaged positions of lever 146, is accomplished without (1) reducing the clearance between bar 152 and aperture 150 or (2) increasing the thickness of lever 146. Thus, the implementation of lever 146 illustrated in FIGS. 5A and 5B may provide the enhancements of a relatively small positional difference between the engaged and unengaged positions without introducing any of the drawbacks associated with a reduced clearance and/or an increased plate thickness. In some embodiments, the thickness of lever 146 is between about 2 mm and about 6 mm (e.g., about 4 mm) and the lock angle of lever 146 is between about 1 degree and about 2 degrees (e.g., about 1.3 degrees-about 1.5 degrees).

It should be appreciated that the implementations of a lever designed to reduce a positional difference between an engaged position and an unengaged position within a clamp illustrated in FIGS. 3A-C, 4A-B, and 5A-B and described above are not intended to be an exhaustive or limiting list of possible implementations. Levers with other configurations that are not substantially straight and are designed to reduce a positional difference between an engaged position and an unengaged position within a clamp may be implemented without departing from the scope of the invention. For example, rather than manipulating the shape of a flat member, as shown in FIGS. 3A-C, 4A-B, and 5A-B, the width of the lever may be varied to provide a similar effect (e.g., the lever may be wedge-shaped).

Further, the disclosure of various aspects of clamp 10 above are not intended to limit the invention to levers disposed within the specific design of clamp 10. Instead, the invention is intended to extend to any implementation of a lever within a clamp used to either drive a bar through a jaw assembly or to provide a brake that holds a jaw assembly in a secure position along a bar. As non-limiting examples, a lever designed to reduce a positional difference between an engaged position and an unengaged position within a clamp may be implemented to replace substantially straight levers within the clamps disclosed in U.S. Pat. No. 6,386,530 to Marks, U.S. Pat. No. 6,474,632 to Liou, U.S. Pat. No. 5,005,449 to Sorensen, U.S. Pat. No. 5,443,246 to Peterson, U.S. Pat. No. 5,265,854 to Whiteford, U.S. Pat. No. 5,853,168 to Drake, and U.S. Pat. No. 5,666,964 to Meilus, and U.S. Patent Application Publication Nos. 2003/0090048 to Verzino et al.; and 2004/0140602 to Gerritsen et al., each of which is incorporated by reference into this disclosure.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A clamp comprising:

a bar;

a jaw assembly configured to receive the bar to therethrough and to be slidably positionable along the bar, the jaw assembly comprising a lever that forms an aperture through which the bar passes, the lever being movable between an engaged position and a disengaged position within the jaw assembly, wherein if the lever is at the disengaged position within the jaw assembly the lever is slidable along the bar and if the lever is at the engaged position within the jaw assembly the lever engages the bar to hold the lever at a fixed position along the bar, and wherein the lever includes one or more inner edge surfaces that form the aperture and one or more distal edge surfaces that form an outer edge of the lever, and wherein the lever is shaped such that if the lever is at the engaged position within the jaw assembly, one or more of the inner edge surfaces of the lever engage a first side of the bar and one or more of the distal edge surfaces of the lever engage a side of the bar opposed to the first side.

2. The clamp of claim 1, wherein the shape of the lever reduces the positional difference between the engaged position and the disengaged position relative to the positional difference of the engaged position and the disengaged position of a lever formed generally as a substantially straight member.

3. The clamp of claim 1, wherein the lever has a hook-like shape from an elevation view.

4. The clamp of claim 1, further comprising a trigger operatively coupled to the lever, wherein the trigger is configured to be engaged by a user to actuate the lever from the engaged position to the disengaged position.

5. A jaw assembly for a bar clamp, the jaw assembly comprising:

a housing configured to enable a bar to pass therethrough;

a lever disposed within the housing, the lever forming an aperture adapted to receive the bar therethrough, the lever being movable between an engaged position and a disengaged position within the housing, wherein if the lever is at the disengaged position within the housing the lever is slidable along the bar and if the lever is at the engaged position within the housing the lever engages the bar to hold the lever at a fixed position along the bar, and wherein the lever includes one or more inner edge surfaces that form the aperture and one or more distal edge surfaces that form an outer edge of the lever, and wherein the lever is shaped such that if the lever is at the engaged position within the jaw assembly, one or more of the inner edge surfaces of the lever engage a first side of the bar and one or more of the distal edge surfaces of the lever engage a side of the bar opposed to the first side.

6. The jaw assembly of claim 5, wherein the shape of the lever reduces the positional difference between the engaged position and the disengaged position relative to the positional difference of the engaged position and the disengaged position of a lever formed generally as a substantially straight member.

7. The jaw assembly of claim 5, wherein the lever has a hook-like shape from an elevation view.

8. The jaw assembly of claim 5, further comprising a trigger operatively coupled to the lever, wherein the trigger is configured to be engaged by a user to actuate the lever from the engaged position to the disengaged position.

9. A lever for use in a jaw assembly of a bar clamp, the lever comprising:

one or more distal edge surfaces forming an outer edge of the lever; and one or more inner edge surfaces forming an aperture configured to receive a bar therethrough such that (i) if the lever is at a disengaged position within the jaw assembly the bar will slide through the aperture and (ii) if the lever is at an engaged position within the jaw assembly the lever will engage the bar to hold the lever at a fixed position along the bar, wherein the lever has a hook-like shape from an elevation view.

10. The lever of claim 9, wherein the shape of the lever reduces the positional difference between the engaged position and the disengaged position relative to the positional difference of the engaged position and the disengaged position of a lever formed generally as a substantially straight member.

11. The lever of claim 9, wherein the lever is shaped such that if the lever is at the engaged position within the jaw assembly, one or more of the inner edge surfaces of the lever engage a first side of the bar and one or more of the distal edge surfaces of the lever engage a side of the bar opposed to the first side.

12. A lever for use in a jaw assembly of a bar clamp, the lever forming an aperture to receive a bar therethrough, the lever comprising:

a first surface;

a second surface opposite the second surface;

a first engagement portion that engages one side of the bar when the lever is in an engaged position, the first engagement portion being formed at or near the first surface of the lever;

a second engagement portion that engages an opposite side of the bar when the lever is in the engaged position, the second engagement portion being formed at or near the second surface of the lever;

the lever being formed with a wedge shape in an elevation view such that a thickness between the first surface and the second surface in a region proximate the first engagement portion is greater than a thickness between the first surface and the second surface in a region proximate to the second engagement portion.

* * * * *